US008272305B2

(12) United States Patent
Xu et al.

(10) Patent No.: US 8,272,305 B2
(45) Date of Patent: Sep. 25, 2012

(54) MULTI-GEAR SYNCHRO-MOVING RIVING KNIFE SYSTEM WITH QUICK RELEASE DEVICE

(75) Inventors: Qing Hai Xu, Nanjing (CN); Yi Hua, Nanjing (CN)

(73) Assignee: Nanjing Haiwei Machinery Co., Ltd., Nanjing (CN)

( * ) Notice: Subject to any disclaimer, the term of this patent is extended or adjusted under 35 U.S.C. 154(b) by 485 days.

(21) Appl. No.: 12/509,979

(22) Filed: Jul. 27, 2009

(65) Prior Publication Data

US 2011/0017037 A1 Jan. 27, 2011

(51) Int. Cl.
*B27G 19/08* (2006.01)

(52) U.S. Cl. ..... 83/102.1; 83/477.2

(58) Field of Classification Search ..... 83/102.1, 83/477.2, 440.2, 478, 544, 860, DIG. 1
See application file for complete search history.

(56) References Cited

U.S. PATENT DOCUMENTS

| | | | | |
|---|---|---|---|---|
| 6,840,144 | B2 * | 1/2005 | Huang | 83/102.1 |
| 7,458,301 | B2 * | 12/2008 | Yu | 83/102.1 |
| 2005/0188806 | A1 * | 9/2005 | Garcia et al. | 83/471.3 |
| 2007/0157784 | A1 * | 7/2007 | Gass et al. | 83/581 |
| 2007/0227327 | A1 * | 10/2007 | Liu et al. | 83/477.2 |
| 2008/0022820 | A1 * | 1/2008 | Merhar et al. | 83/102.1 |
| 2009/0288303 | A1 * | 11/2009 | Liao | 30/293 |

* cited by examiner

*Primary Examiner* — Stephen Choi
(74) *Attorney, Agent, or Firm* — Jen-Feng Lee

(57) ABSTRACT

Present invention teaches to build a woodworking table saw where, a splitter/riving knife move with the saw blade in a synchronized manner, with an idle gear engaging in planetary circular action around a fixed quadrant gear and the outer gear teeth portion of a support arm, so that any height adjustment or angle tilting done to the saw blade will result in the same movement of the splitter/riving knife, maintaining the constant linear difference (usually 5 mm) between the saw blade and the splitter/riving knife. In addition, to facilitate the installation, changeover, and/or removal of the splitter/riving knife, a spring pressure plate mechanism is used, along with lug bolts and a spring loaded secure pin device to easily set the splitter/riving knife in a pre-set position without using tools and in shorter time duration.

8 Claims, 9 Drawing Sheets

MULTI-GEAR SYNCHRO-MOVING RIVING KNIFE SYSTEM WITH QUICK RELEASE DEVICE

FIELD AND BACKGROUND OF THE INVENTION

The present invention relates generally to a splitter, also called riving knife system, used on table saw with quick release device for change over of splitter and/or riving knife.

Woodworking machines such as table saws typically have a splitter behind the saw blade, to hold cut work pieces from closing and to prevent the accidental "kickback" of work pieces that are thrown back to the operators, which often times result in injury to the operators.

Traditionally, most of the splitters are mounted on the work table of the table saw; consequently, there are two main disadvantages: one, the splitter does not maintain a constant distance to the saw blade as the blade is being adjusted for different heights; two, if different splitter is needed (for example, to correspond to different arc radius or thickness of different saw blade), the task for the changeover, removal and/or putting in new splitter is difficult and time-consuming.

In a non-through cutting scenario (groove cutting), this type of surface-mounted splitter has to be removed, for the intended groove to be cut. In this case, only a riving knife that is "mounted" to the housing for the saw blade can fit the purpose of the cut. However, the current splitter system on the market requires about 20 minutes or longer to make the change over from splitter to riving knife, and it normally requires proper tools to make the change. Operators, in their attempt to save time, sometimes would forego the installation of riving knife and simply start working on work pieces after splitter is removed, greatly enhancing possibility for the injuries that can be brought about by the "kickback" of work pieces.

Also the current riving knife system on the market does not maintain a constant height difference between the saw blade and the riving knife which is very important for effective prevention of kickbacks. Whenever the saw blade is set to different height (to cut different groove, for example), a separate effort to adjust the position of the riving knife is required, after the effort of adjusting the saw blade is done. This time-consuming work also very likely prevent operator from using riving knife for non-through cutting.

To reach a better safety standard, the trend in the woodworking industry is to have properly shaped and designed splitter and/or riving knife that move with the blade in a synchronized manner, so that at any adjusted blade position, the splitter/riving knife will stay in certain linear distance relative to the blade (range from 3-8 mm, with 5 mm being the norm) resulting in a constant and safe working condition for the operators. Also, it would be a desirable feature to shorten the time spent on the changeover from splitter to riving knife, and vice versa. Preferably, the market would appreciate a changeover time of less than 30 seconds. The short changeover time will be of greater value, when no tools is needed, as disclosed and taught in present invention.

To respond to this market trend and preference, present invention deals with the problems of current splitter/riving knife system on the market, by using a unique multi-gear system to keep the splitter/riving knife at a constant linear difference to the saw blade, and a spring pressure plate mechanism for easy changeover and installation of splitter and riving knife without tools.

For the need to put in new splitter or riving knife, or have a changeover from a splitter to a riving knife, present invention disclosed a system of quick release and installation by way of a spring pressure plate with lug nuts securing the riving knife quickly to a pre-determined position.

The riving knife will have a guide slot that slides into the middle lug nut, while having two lug nuts adjacent to the outside edge, making the task of alignment for the newly inserted riving knife very simple and intuitive, thus promoting the proper use of the riving knife and greatly enhancing the safety for the operator of such wood working machines. All these operations will require no tools and will usually take less than 10 seconds.

OBJECTS AND SUMMARY OF THE INVENTION

Present invention teaches to build a woodworking table saw, particularly the part of the saw blade that will have a splitter/riving knife that move with the saw blade in a synchronized manner, so that any height adjustment or angle tilting done to the saw blade, for purpose of any cut to be applied to the work piece, will result in the same movement of the splitter/riving knife, maintaining the constant linear distance between blade and splitter/riving knife (usually 5 mm). In the mean time, when riving knife is used for non-through cutting, the system of present invention will keep riving knife being lower than top of blade by certain distance (usually 3 mm).

In addition, to facilitate the installation, changeover, and/or removal of the splitter/riving knife, a spring pressure plate mechanism is used, along with lug nuts and a locking bolt to easily remove, set and secure the splitter/riving knife in a pre-set position, without using any tools, while allowing easy removal, correcting the time-consuming tasks of setting or changing the riving knife/splitter in the old system, greatly enhancing the efficiency and safety of the system.

Throughout this application, riving knife and splitter are treated as equivalent for purpose of the disclosed invention, unless note otherwise specifically.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

The multi-gear synchro-moving splitter/riving knife system with quick release change over device is made upon a woodworking table saw, constructed and connected into the trunnion and arbor driven structure of a table saw.

Figure 1:
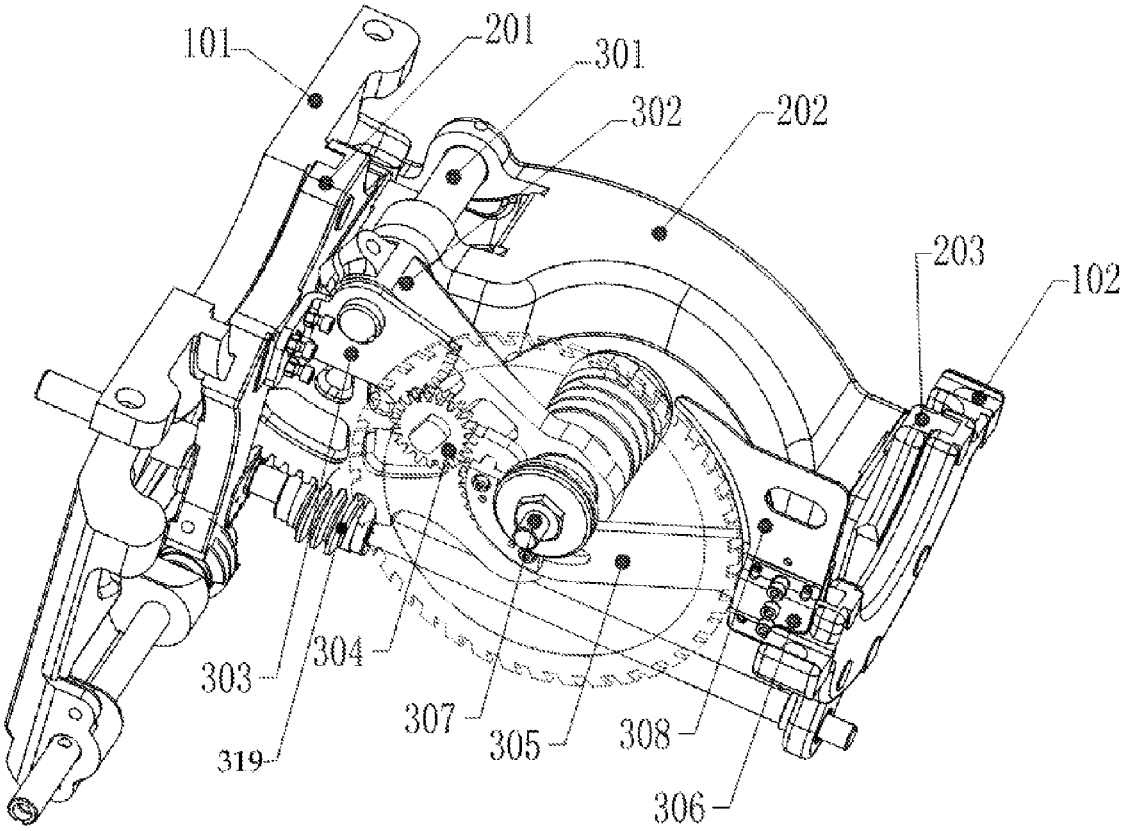
FIG. 1 is the structural perspective view of present invention, showing the multi-gear synchro-moving construction of the riving knife system.
Figure 2:
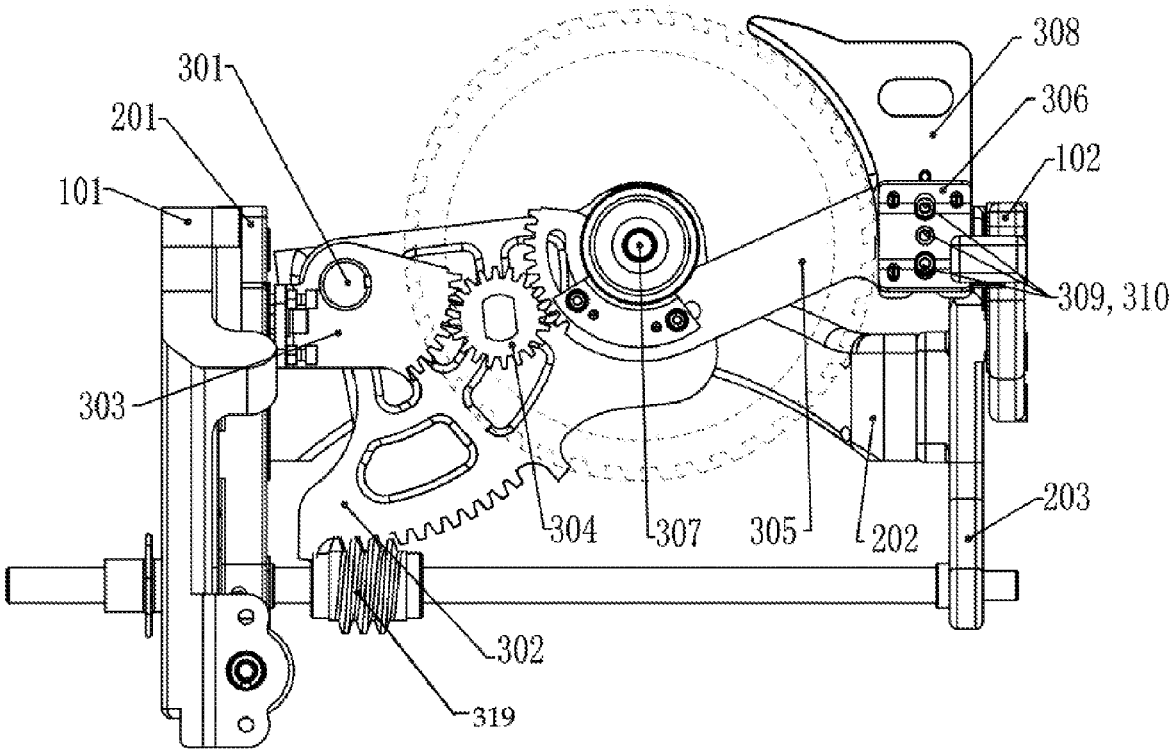
FIG. 2 shows the profile view of the present invention, showing working relations of different parts and components
Figure 3:
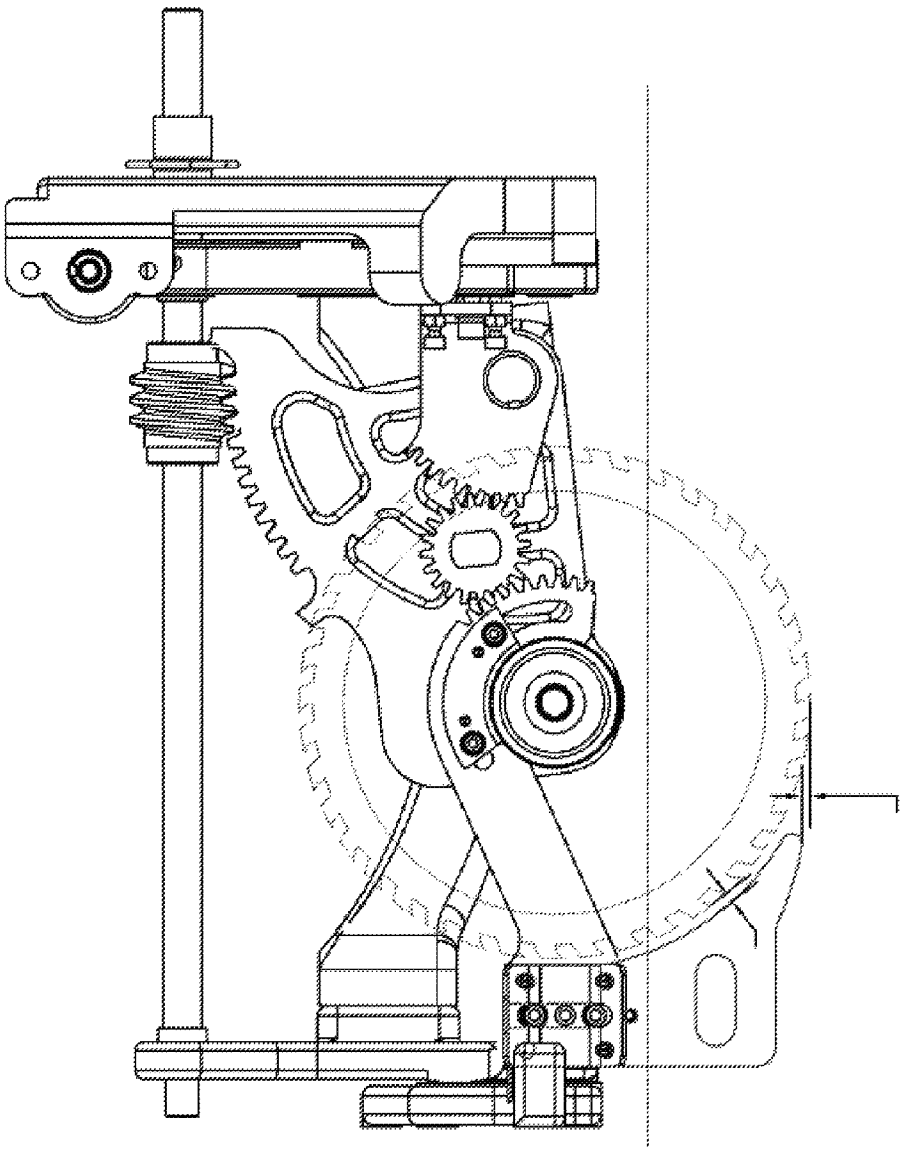
FIG. 3 shows the riving knife positioning with blade being set at the highest position.
Figure 4:
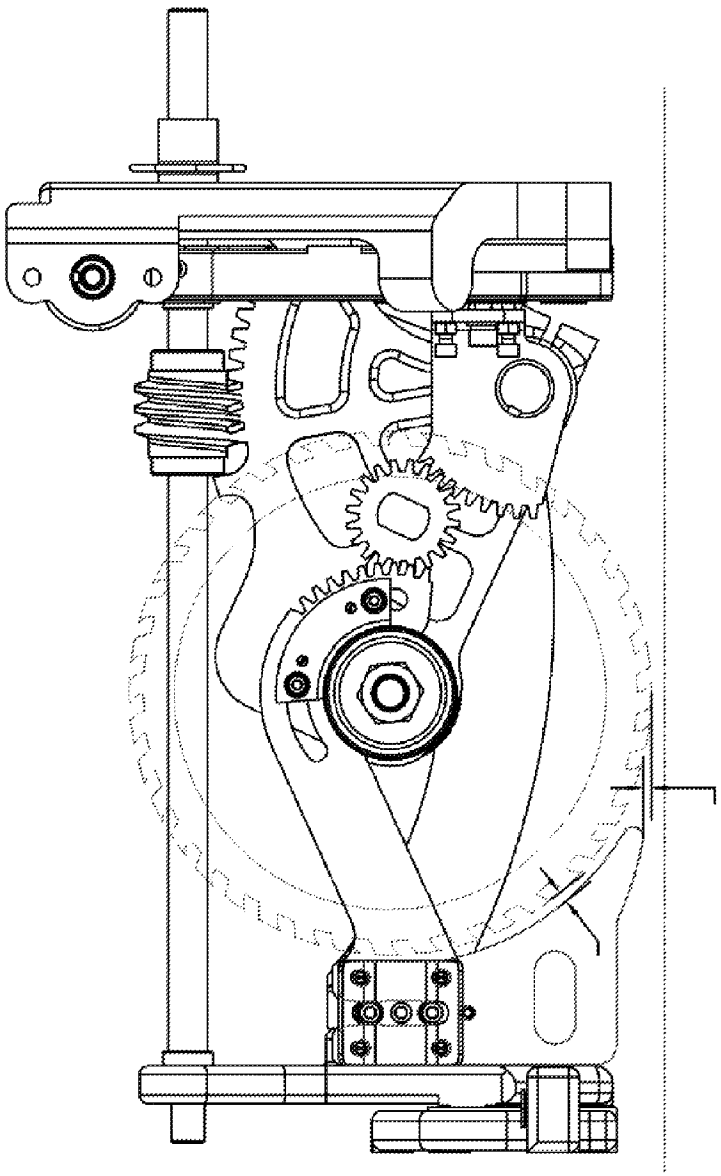
FIG. 4 shows the riving knife positioning with blade being set at the lowest position, and the linear distance and height difference between blade and riving knife remain the same.

As shown on FIG. 1 and FIG. 2, a blade arbor (or blade spindle) 307 is supported by an arbor frame 302 which also served as a section worm wheel with teeth. A cutting blade is mounted on the blade arbor 307.

Thus the blade can cut wood workpieces when it is being driven by an electric motion for the desired spinning/turning.

A worm shaft 319 underneath said arbor frame 302 is turned by a hand wheel (not shown), causing said arbor frame 302 to rotate around a pivot shaft 301, which will move the blade arbor 307 up and down.

As shown in FIGS. 1-4, said worm shaft 319 and said arbor frame 302 are mutually engaged with each other, by the thread on saod worm shaft 310 and the teeth on said arbor frame 302.

Through this arrangement of engagement, the cutting blade can be adjusted up or down for different cutting operations.

Two trunnion half moon blocks 201/203 rotably resting on two female round tracks 101/102, serve to provide the bevel angle adjustment (between 0-45 degrees) for said blade arbor 307, enabling the cutting blade to perform bevel (mitre) cuttings.

Said trunnion half moon blocks 201 and 203 are connected by a connecting arm 202, as shown in FIGS. 1 and 2.

In order to equip the blade with a splitter or riving knife, the present invention provides for a special support arm 305 which is clamped onto said arbor frame 302; its right end (when view as presented in FIG. 2) is used for mounting splitter or riving knife on back of cutting blade.

This special support arm 305, along with the arbor frame 302 being clamped together, will allow the rotation of the cutting blade along the center axle as defined by said blade arbor 307.

Said special support arm 305 contains an outer gear teeth portion (on the left side of the special support arm 305, as viewed on FIGS. 1 and 2) that is generally in a "arc" shape, formed like a cut-out section from a circle, and is in engagement relationship to an idle gear 304, detailed later.

The axle line of said blade arbor 307 will be the center of the radius of the arc for the outer gear teeth of the special support arm 305.

The length of the special support arm 305 and its mounting base for riving knife/splitter are calculated and designed to make sure there is a proper linear distance between blade and riving knife/splitter (usually 5 mm).

Movements of the special support arm 305 are around the center of said blade arbor 307 (which is the same turning center of the cutting blade), so the linear distance between riving knife/splitter and blade will remain the same as originally arranged (5 mm), no matter where the blade is adjusted to.

This design will meet the safety preference where the linear distance between splitter/riving knife and blades are the same at any position of blade; and it solved the problem of old splitter/riving knife system currently on the market.

In addition, the present invention arranged an idle gear 304 with its axle point fixed onto said arbor frame 302. Said idel gear 304 is in engagement relationship to a fixed quadrant gear 303 and the outer gear teeth portion of said special support arm 305. Such arrangement caused the idle gear 304 to rotate around said pivot shaft 301 at the contact point with a fix quadrant gear 303 (detailed later), said pivot shaft 301 is fixed on the arbor frame 302 (see FIG. 2).

A fixed quadrant gear 303 is bolted onto the half moon trunnion block 201 (see FIG. 2). By having said idle gear 304 engaging said quadrant gear 303 and the outer gear teeth portion of said special support arm 305, the idle gear 304 will be engaged in a planetary circular action around the arc center of said fixed quadrant gear 303.

The effective radius for the arc formation of the outer gear teeth portion on said support arm 305 will have the same effective radius as the arc formation of the fixed quadrant gear 303.

In actual commercial production and practice, the outer gear teeth portion of said support arm 305 can be made to be an integrated part of said special support arm 305; it can also be a separate piece and then joined (by welding, for example) to the special support arm 305.

At the highest arbor position (see FIG. 3), when the arbor frame 302 starts to rotate clockwise around said pivot shaft 301 to lower down the cutting blade, riving knife/splitter will be lowered as well.

Traditionally, the rotation radius of riving knife/splitter is much larger (normally 2 times larger) than the rotation radius of a corresponding blade arbor. As a result, the riving knife/splitter is lowered about twice much more than the cutting blade, therefore the height difference between blade top tip and riving knife is changed (to be larger), which obviously is not a desired feature.

The present invention's special arrangement solved this problem by the following movements: When the arbor frame 302 is rotating clockwise (downwards), the fixed quadrant gear 303 will cause the idle gear 304 to rotate clockwise, the idle gear 304 then drives the special support arm 305 (with rack teeth) to rotate counter-clockwise around the center axle of said blade arbor 307.

The simultaneous counter-clockwise rotation of the special support arm 305 causes riving knife/splitter to move up, which will compensate the difference of lowering distance between riving knife/splitter and the blade mentioned above.

This compensation works equally in the other direction when the blade arbor 307 is moving up (with simultaneous clock-wise rotation of the special support arm 305, when the idle gear 304 is rotating counter-clockwise).

Therefore, the height difference between riving knife/splitter and the blade top tip will be kept unchanged (see FIG. 3 and FIG. 4) which meets the market demand, and this function is performed in a synchronized manner that eliminates the needs of any additional manual adjustments when blade position is changed.

In the case where the splitter needs to be changed to riving knife for non-through cutting operations, the spring pressure plate mechanism of present invention provides an efficient design to achieve that purpose, which requires no tools and usually takes less than 10 seconds.

Reference FIGS. 5-10 for this portion of the toolless easy-changing and quick release feature.

Riving knife 308 is attached to a base seat 315 by the combination of a spring pressure plate 306 and three lug bolts 309.

A guide slot "b" (see FIG. 8) is formed on the riving knife 308. To install a riving knife 308 to the base seat 315, said riving knife 308 is inserted to position by lining up the guide slot "b" through the bolts 309 in the middle, with two adjacent lug bolts 309 on the outside edge of riving knife 308.

Figure 5:
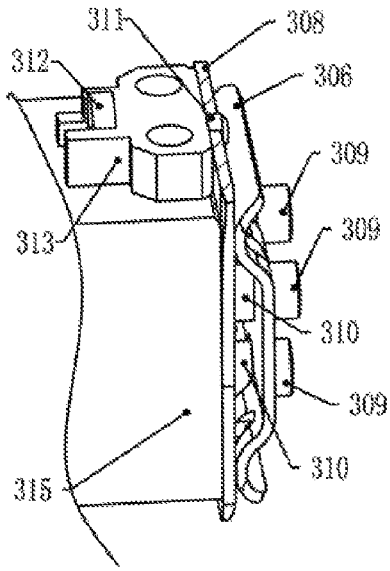
FIG. 5 is the perspective view of the riving knife quick release structure.
Figure 10:
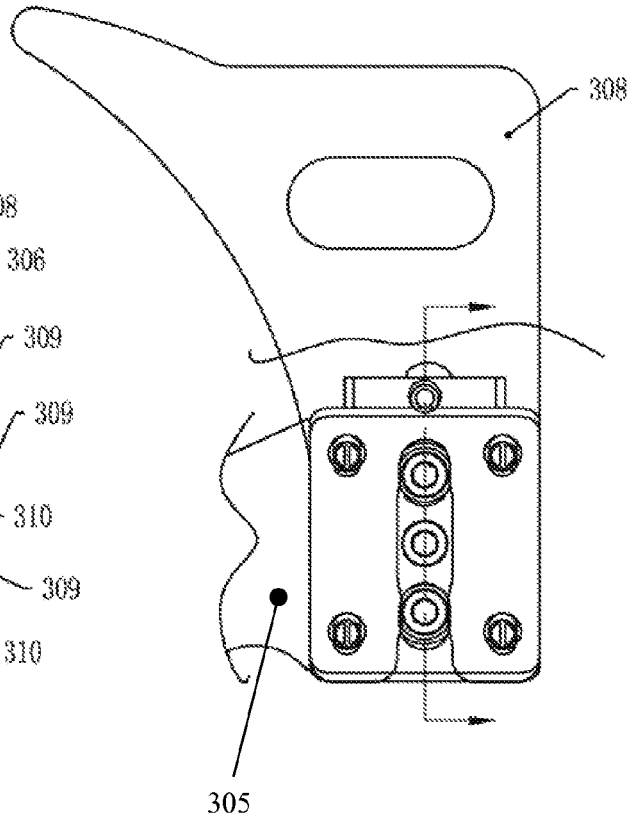
FIG. 10 is the perspective view of the quick release system mounted onto the base seat of the support arm.
Figure 6:
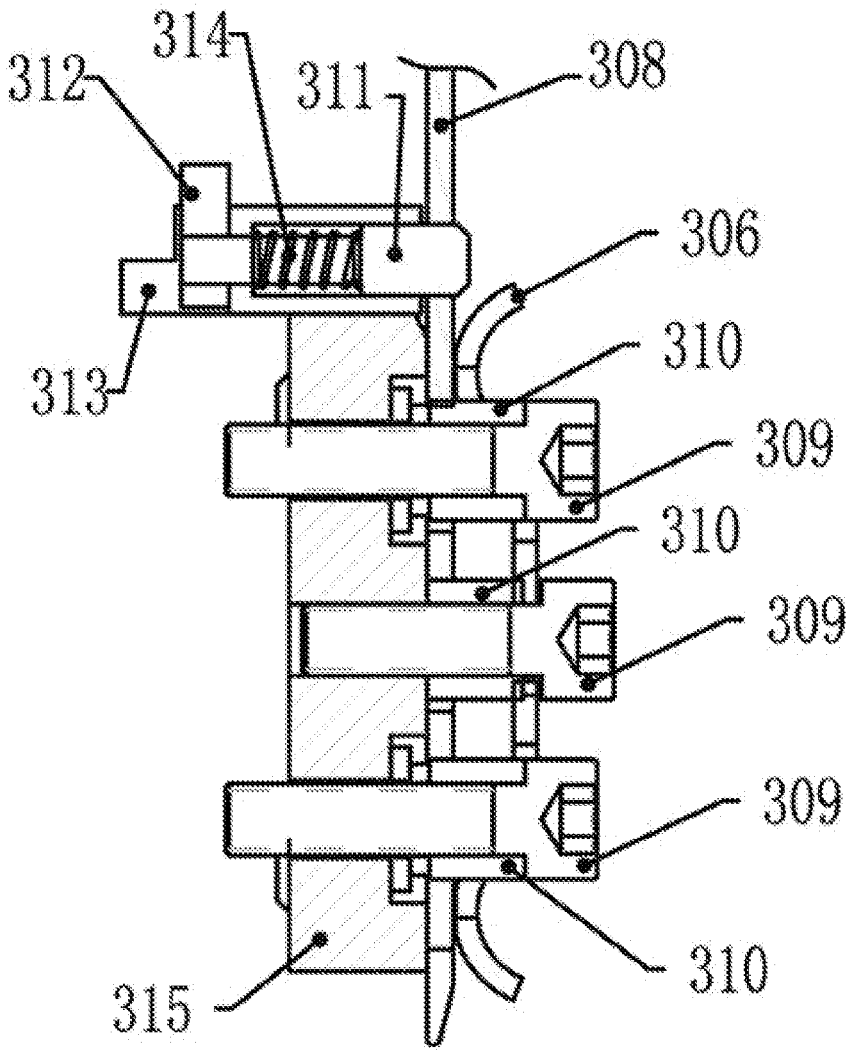
FIG. 6 shows the profile view of the riving knife quick release structure showing a spring-loaded pin for securing riving knife by the use of a spring pressure plate, in addition to the three lug bolts locking down the spring plate.

The riving knife 308 is kept tight to the base seat 315 by the pressure applied by a spring pressure plate 306, as well as the pressure from the tightened middle lug bolt 309 (the spring pressure plate 306 is positioned by the middle lug bolt with a collar 310), as shown by FIGS. 5 and 6. As can be seen easily, the gap between the spring pressure plate 306 and the base seat 315 is smaller than that of the thickness of riving knife 308.

Figure 7:
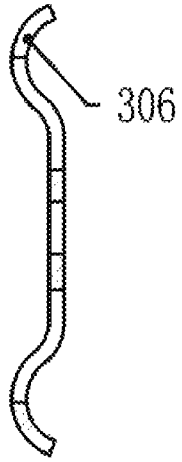
FIG. 7 shows a preferred shape of a spring pressure plate.
Figure 9:
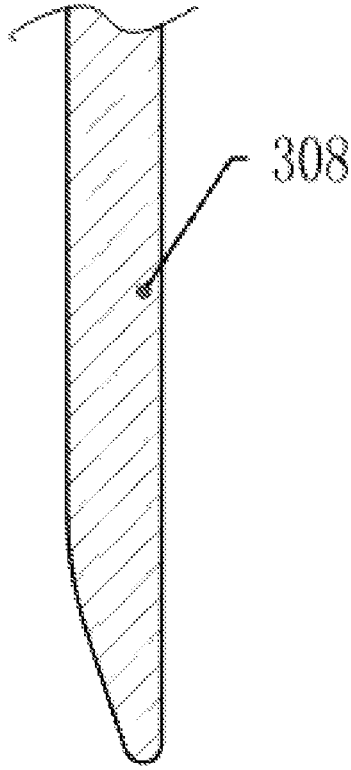
FIG. 9 is a cut-off section view of the bottom shape of splitter/riving knife.
Figure 8A:
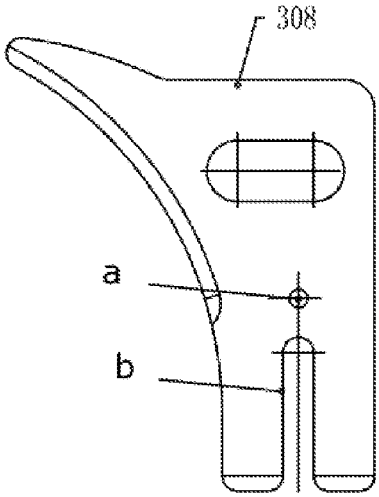
FIGS. 8(*a*) and 8(*b*) show the side views of the riving knife (a) and splitter (b), with a guide slot and a positioning pin hole shown.
Figure 8B:
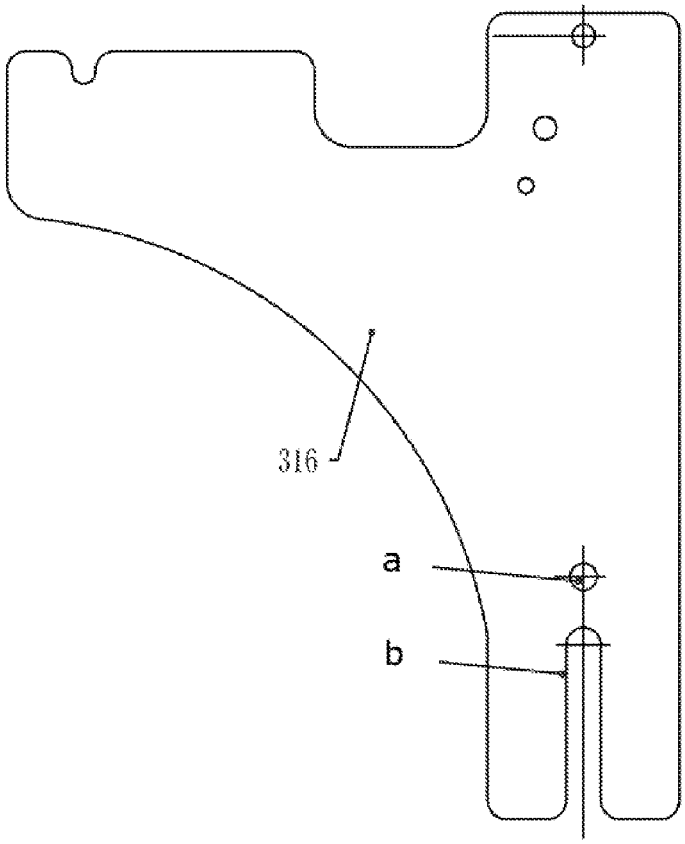
Figure 11:
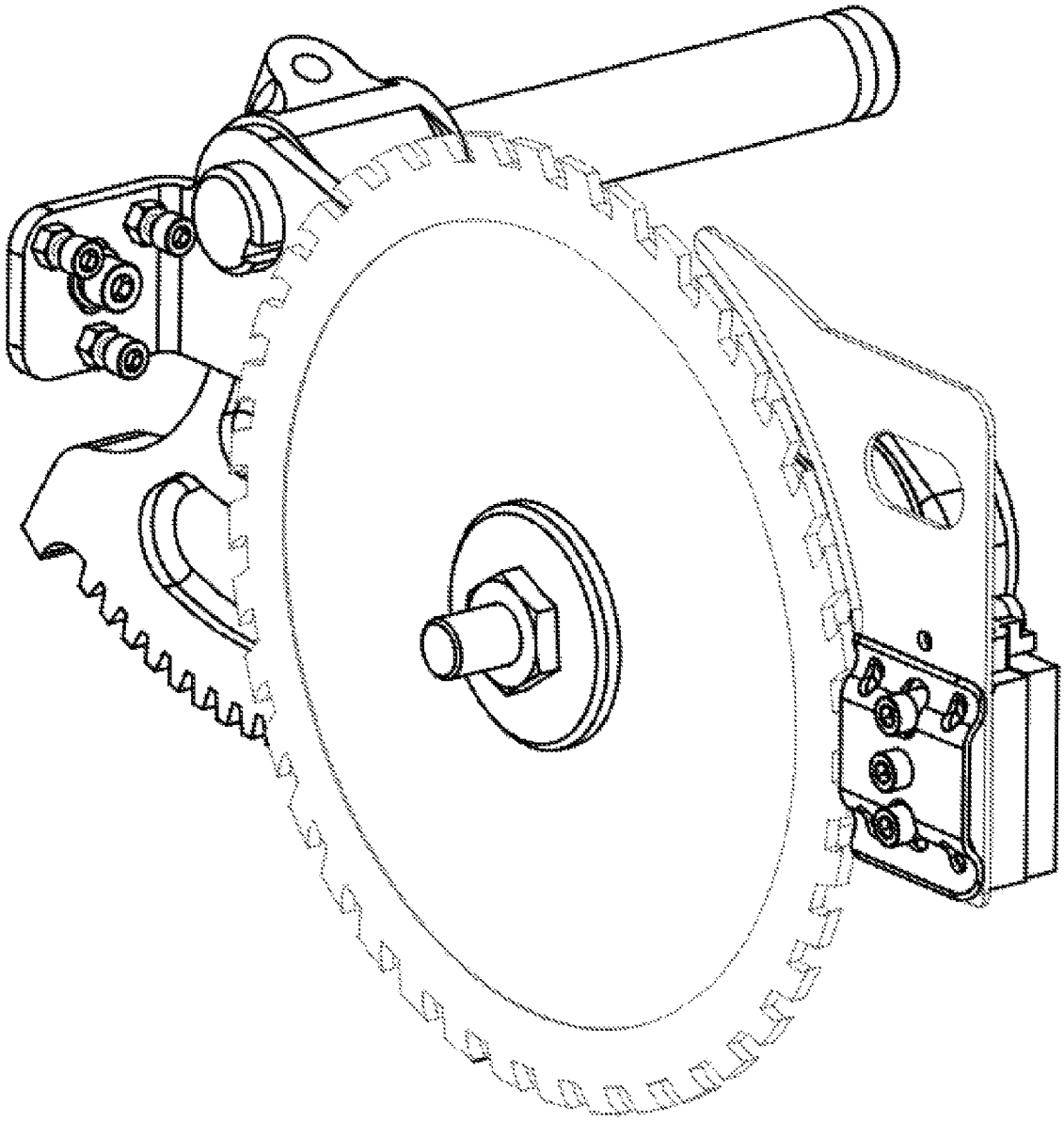
FIG. 11 shows the assembled view of a riving knife to the base seat of the support arm pursuant to the disclosure of present invention.

The spring pressure plate 306 is formed to provide the resilient power similar to the same principle that a bow provides the resilient force to propel out an arrow. The desired shape of the spring pressure plate 306 is shown in FIGS. 7, as an example.

Three washer-collars 310, in conjunction with the three lug bolts 309, serve both to align the position of the riving knife 308 and keep it from moving sideward.

The depth of insertion of riving knife 308 is determined by the guide slot "b" (see FIG. 8) and the position of the upper lug bolt 309.

A secure pin hole "a" (see FIG. 8) is formed on the riving knife 308, so that a secure pin 311 can be pushed forward by spring 314 into secure pin hole "a" (the secure pin 311 will stay in the pin hole "a" by pressure of the spring 314), when riving knife 308 is being inserted into its final position. The secure pin 311 keeps the riving knife 308 in position and prevents the riving knife 308 from being pulled out of the base seat 315.

Said spring-loaded secure pin 311 is part of a safety locking device for the installation of riving knife 308 where a bolt housing 313 is formed to the top side of the base seat 315. A small knob 312 is mounted on the left end (as viewed from the perspective presented by FIG. 6) of secure pin 311, and it is used for pulling back the secure pin 311 and locking it inside the housing 313 when inserting and pulling out the riving knife 308.

As such, when a riving knife 308 is to be changed or removed, an operator can "flick" secure pin 311 away from the pin hole "a" in the riving knife 308 (pushing against the resilient force of spring 314) and lock the knob 312 in a groove of housing 313, then easily pull out the riving knife 308. When a splitter 316 (see FIG. 8) is to be put in, the operator inserts the splitter 316 (see FIG. 8) into the gap between spring plate 306 and base seat 315, and push the splitter 316 all the way to the bottom until the upper lug bolt 309 reaches the inside closed end of the guiding slot "b", then release the knob 312, the secure pin 311 will naturally "click" into the secure pin hole "a" in the splitter 316 by force of spring 314, the splitter 316 will be secured firmly in position, and ready for use. As the riving knife 308 and splitter 316 are designed with the same bottom guide slots and pin holes, the installation and/or change over (for both splitter or riving knife) will be the same operation and extremely easy without any tools.

Finally, the said Multi-Gear Synchro-Moving Riving Knife System With Quick Release Device is very economic in engineering and manufacturing, and it can be used on most of the existing table saws with little added cost which will greatly reduce the accidental injuries to operators.

What is claimed is:

1. A multi-gear synchro-moving riving knife/splitter system with quick release device, comprising:

a. a connecting arm to hold a pivot shaft;

b. two female round tracks;

c. two half moon trunnion blocks that can slidably turn and pivot on the two female round tracks;

d. a fixed quadrant gear pivoting on said pivot shaft;

e. an arbor frame;

f. an idle gear having its axle placed on said arbor frame;

g. a special support arm whose one end holds an blade arbor;

h. a riving knife/splitter attached to a base seat that is secured to another end of said special support arm; and, i. said support arm contains an outer gear teeth portion that is engaged to said idle gear, which in turn is engaged to said fixed quadrant gear, and said rotational axle of idle gear is placed on said arbor frame, so that the idle gear engages in planetary circular action around the arc center of said fixed quadrant gear.

2. The system of claim 1, wherein the arc formation of the outer gear teeth portion on said support arm has the same equivalent radius as the radius of the fixed quadrant gear.

3. The system of claim 1, wherein the outer gear teeth portion is an integral part of said support arm.

4. A multi-gear synchro-moving riving knife/splitter system with quick release device, comprising:

a. a connecting arm to hold a pivot shaft;

b. two female round tracks;

c. two half moon trunnion blocks that can slidably turn and pivot on the two female round tracks;

d. a fixed gear pivoting on said pivot shaft;

e. an arbor frame;

f. an idle gear having its axle placed on said arbor frame;

g. a special support arm whose one end holds a blade arbor;

h. a riving knife/splitter attached to a seat that is secured to another end of said support arm;

i. said special support arm contains an outer gear teeth portion that is engaged to said idle gear, which in turn is engaged to said fixed quadrant gear, and said rotational axle of idle gear is placed on said arbor frame, so that the idle gear engages in planetary circular action around the arc center of said fixed quadrant gear; and, j. a quick release mechanism for easy installation and removal of riving knife/splitter to be securely attached to a base seat by the combination of a spring pressure plate and three lug nuts wherein one of the lug nuts slides into a guide slot in the riving knife and two lug bolts adjacent to the outer edge of the riving knife/splitter.

5. The system of claim 4, where the spring pressure plate is formed in a shape that provides a resilient force similar to the nature of a bow.

6. The system of claim 5, wherein a spring-loaded secure pin can be easily lock into a hole on the riving knife/splitter, by a knob extending out from the secure pin in a direction perpendicular to the axle direction of said secure pin, placed inside a housing on the side of said base seat.

7. The system of claim 5, wherein said spring pressure plate is made from suitable rigid material.

8. The system of claim 5, wherein said spring pressure plate is made from steel.

* * * * *